US009100731B2

(12) United States Patent
Turnbull et al.

(10) Patent No.: US 9,100,731 B2
(45) Date of Patent: Aug. 4, 2015

(54) LOW POWER MICROPHONE CIRCUITS FOR VEHICLES

(71) Applicant: Gentex Corporation, Zeeland, MI (US)

(72) Inventors: Robert R Turnbull, Holland, MI (US); Michael A Bryson, Hudsonville, MI (US)

(73) Assignee: GENTEX CORPORATION, Zeeland, MI (US)

( * ) Notice: Subject to any disclaimer, the term of this patent is extended or adjusted under 35 U.S.C. 154(b) by 18 days.

(21) Appl. No.: 13/759,368

(22) Filed: Feb. 5, 2013

(65) Prior Publication Data

US 2013/0202142 A1 Aug. 8, 2013

Related U.S. Application Data

(60) Provisional application No. 61/595,359, filed on Feb. 6, 2012.

(51) Int. Cl.
*G10K 11/16* (2006.01)
*H04R 3/00* (2006.01)

(52) U.S. Cl.
CPC *H04R 3/00* (2013.01); *G10K 11/16* (2013.01); *H04R 2410/00* (2013.01); *H04R 2499/13* (2013.01)

(58) Field of Classification Search
USPC ..... 381/71.5, 71.7, 314, 312, 320
See application file for complete search history.

(56) References Cited

U.S. PATENT DOCUMENTS 5,566,224 A 10/1996 ul Azam et al.
5,848,168 A * 12/1998 Shipps et al. ..... 381/71.5
5,878,353 A 3/1999 ul Azam et al.
6,107,788 A * 8/2000 Oya et al. ..... 323/299
6,243,003 B1 6/2001 DeLine et al.
6,278,377 B1 8/2001 DeLine et al.
6,420,975 B1 7/2002 DeLine et al.
6,433,676 B2 8/2002 DeLine et al.
6,466,136 B2 10/2002 DeLine et al.
6,466,678 B1 * 10/2002 Killion et al. ..... 381/314
6,614,911 B1 9/2003 Watson et al.
6,650,233 B2 11/2003 DeLine et al.
6,717,524 B2 4/2004 DeLine et al.
6,882,734 B2 4/2005 Watson et al.
7,120,261 B1 10/2006 Turnbull et al.

(Continued)

FOREIGN PATENT DOCUMENTS

JP 07266888 10/2007
KR 100694280 3/2007

(Continued)

*Primary Examiner* — Davetta W Goins
*Assistant Examiner* — Amir Etesam
(74) *Attorney, Agent, or Firm* — Price Heneveld LLP; Scott P. Ryan

(57) ABSTRACT

A low power microphone circuit for a vehicle is provided that includes: at least one microphone transducer; a digital signal processor for receiving output signals from the at least one microphone transducer and for generating a digitally processed audio signal; an output amplifier for amplifying the audio signal from the digital signal processor and modulating an input voltage with the audio signal; and a DC power supply for supplying power to the digital signal processor. The output amplifier and the DC power supply may be electrically coupled in series. The DC power supply and the output amplifier may be powered by the input current, where the input current is no greater than about 6 mA.

22 Claims, 9 Drawing Sheets

(56) References Cited

U.S. PATENT DOCUMENTS

| | | | | |
|---|---|---|---|---|
| 7,382,289 | B2 | 6/2008 | McCarthy et al. | |
| 7,447,320 | B2 | 11/2008 | Bryson et al. | |
| 7,468,652 | B2 | 12/2008 | DeLine et al. | |
| 7,522,737 | B2 | 4/2009 | Solderits | |
| 7,542,575 | B2 | 6/2009 | DeLine et al. | |
| 7,826,623 | B2 | 11/2010 | Christoph | |
| 8,000,894 | B2 | 8/2011 | Taylor et al. | |
| 8,004,392 | B2 | 8/2011 | DeLine et al. | |
| 8,243,956 | B2 | 8/2012 | Turnbull | |
| 8,350,683 | B2 | 1/2013 | DeLine et al. | |
| 2006/0233405 | A1* | 10/2006 | Brooks et al. | 381/312 |
| 2007/0291962 | A1 | 12/2007 | Watson et al. | |
| 2012/0027241 | A1 | 2/2012 | Turnbull et al. | |

FOREIGN PATENT DOCUMENTS

| | | |
|---|---|---|
| RU | 45215 | 12/2004 |
| WO | 0137519 | 11/2000 |

* cited by examiner

LOW POWER MICROPHONE CIRCUITS FOR VEHICLES

CROSS-REFERENCE TO RELATED APPLICATION

This application claims the priority benefit of U.S. Provisional Patent Application No. 61/595,359 entitled "POWER SUPPLY FOR USE IN A LOW POWER MICROPHONE OUTPUT STAGE," filed on Feb. 6, 2012, by Robert R. Turnbull et al., the entire disclosure of which is incorporated herein by reference.

FIELD OF THE INVENTION

The present invention generally relates to a low power microphone circuit, and more particularly relates to a low power microphone circuit of the type used in vehicles.

BACKGROUND OF THE INVENTION

Microphones are commonly used in vehicular applications to control vehicle telematics using speech recognition and to interface with mobile telephones. Conventional microphone circuits typically included a DC power supply for powering a digital signal processor (DSP), and an output amplifier for amplifying the signals from the DSP. The DC power supply and the output amplifier were coupled in parallel so that input voltages of about 5V were available to both the DC power supply and the output amplifier, and there was sufficient current to power both components.

Recently, however, automobile manufacturers have sought to reduce power consumption by the various circuits in automobiles, particularly in electric and hybrid automobiles, as current draw by these circuits reduces the operating mileage range per charge of the batteries. Accordingly, with respect to microphones, it is now desirable to limit the power available to microphones, particularly the current draw of such microphone circuits. However, in the conventional microphone circuits, the input current must be split between the DSP and the output amplifier. This results in too low of a current level to drive the DSP.

A VDA interface is commonly used in automotive systems for reasons of low cost, elimination of ground loops and the ability to use unshielded wiring in some implementations. The power limitation described above can particularly become an issue in a microphone with extensive analog signal processing powered by a VDA interface. In situations where a class-B amplifier output stage is used, a maximum efficiency of only about 30% for sine wave signals is possible which typically requires high amounts of supply current.

SUMMARY OF THE INVENTION

According to one embodiment, a low power microphone circuit for a vehicle is provided that comprises: at least one microphone transducer; a digital signal processor for receiving output signals from the at least one microphone transducer and for generating a digitally processed audio signal; an output amplifier for amplifying the audio signal from the digital signal processor and modulating an input voltage with the audio signal; and a DC power supply for supplying power to the digital signal processor, wherein the output amplifier and the DC power supply are electrically coupled in series.

According to another embodiment, a low power microphone circuit for a vehicle is provided that comprises: at least one microphone transducer; a digital signal processor for receiving output signals from the at least one microphone transducer and for generating a digitally processed audio signal; a terminal for connection to a vehicle power source providing an input voltage and an input current; an output amplifier for amplifying the audio signal from the digital signal processor and modulating the input voltage with the audio signal; and a DC power supply for supplying power to the digital signal processor, wherein the DC power supply and the output amplifier are powered by the input current, and wherein the input current is no greater than about 6 mA.

According to another embodiment, a method is provided for providing power to a microphone circuit having a digital signal processor, an output amplifier, and a DC power supply, when a power source from which power is to be provided has an input current of no greater than about 6 mA. The method comprises: electrically connecting the output amplifier and the DC power supply in series such that the input current passes through both the output amplifier and the DC power supply; and providing power from the DC power supply to the digital signal processor.

These and other features, advantages, and objects of the present invention will be further understood and appreciated by those skilled in the art by reference to the following specification, claims, and appended drawings.

DETAILED DESCRIPTION OF PREFERRED EMBODIMENTS

Figure 1:
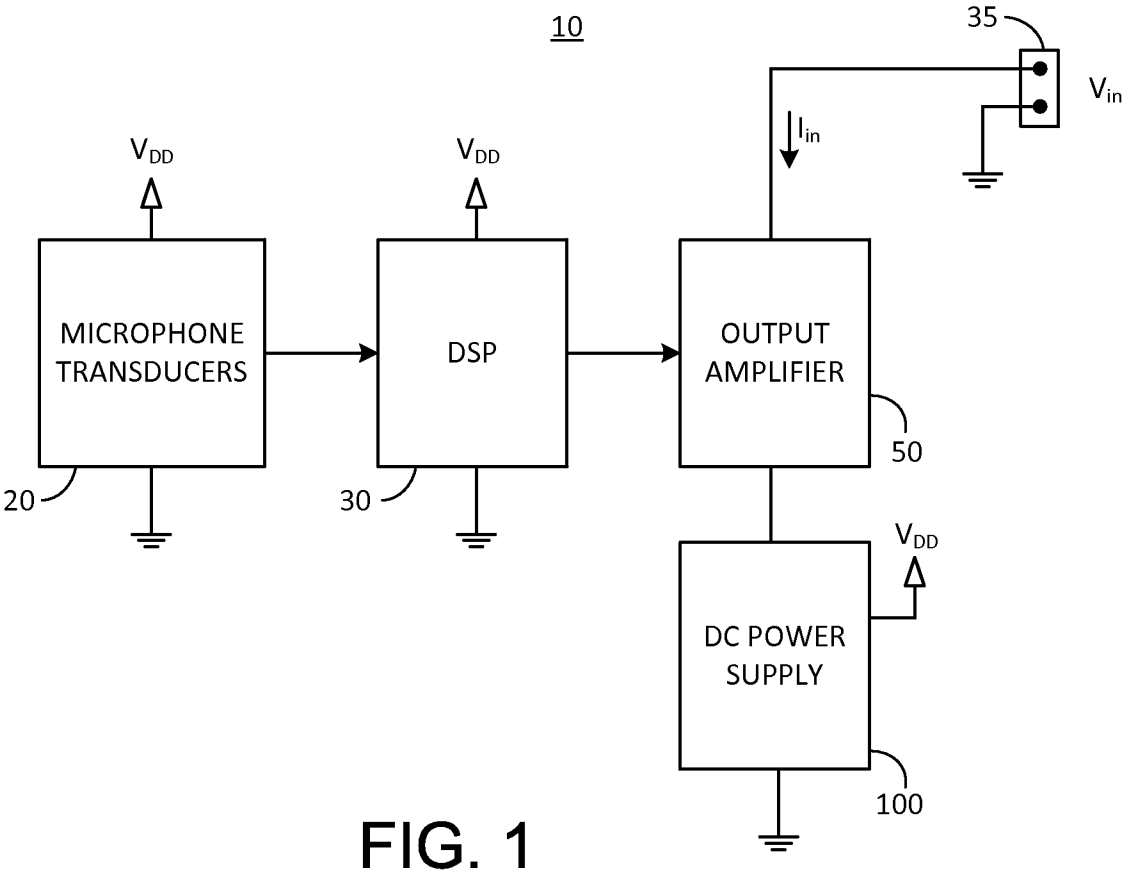
FIG. 1 is an electrical circuit diagram in block form of a microphone circuit according to one embodiment.

Reference will now be made in detail to the present preferred embodiments of the invention, examples of which are illustrated in the accompanying drawings. Wherever possible, the same reference numerals will be used throughout the drawings to refer to the same or like parts. In the drawings, the depicted structural elements are not to scale and certain components are enlarged relative to the other components for purposes of emphasis and understanding.

FIG. 1 shows a first embodiment of a low power microphone circuit 10 that may be used in a vehicle. Low power microphone circuit 10 may include: at least one microphone transducer 20; a digital signal processor (DSP) 30 for receiving output signals from the at least one microphone transducer 20 and for generating a digitally processed audio signal; a terminal 35 for connection to a vehicle power source 40, which provides an input voltage $V_{in}$ and an input current $I_{in}$; an output amplifier 50 for amplifying the audio signal from DSP 30 and modulating the input voltage with the audio signal; and a DC power supply 100 for supplying power to DSP 30.

DC power supply 100 and output amplifier 50 are powered by the input current $I_{in}$. According to some embodiments described herein, the input current $I_{in}$ made available from the vehicle is no greater than about 6 mA, and possibly no greater than about 4.7 mA. To address the problems with the conventional microphone circuits discussed above, in some of the embodiments, output amplifier 50 and the DC power supply 100 are electrically coupled in series between input terminal 35 and ground so as to not split the input current $I_{in}$ between these two components. As shown, output amplifier 50 is coupled between terminal 35 and DC power supply 100, and DC power supply 100 is coupled between output amplifier 50 and ground. The inventors discovered that when output amplifier 50 and the DC power supply 100 are coupled in series, the voltage $V_{DD}$ supplied to DSP 30 from DC power supply 100 is sufficiently high for operation. In particular, if $V_{DD}$ is about 1.5 V nominal, it is sufficient to power DSP 30. In this way, both output amplifier 50 and DC power supply receive the full input current $I_{in}$ of, for example, about 6 mA or less. Despite the low power supplied, the microphone circuit 10 provides more gain in the output stage in order to drive a higher output.

Figure 2:
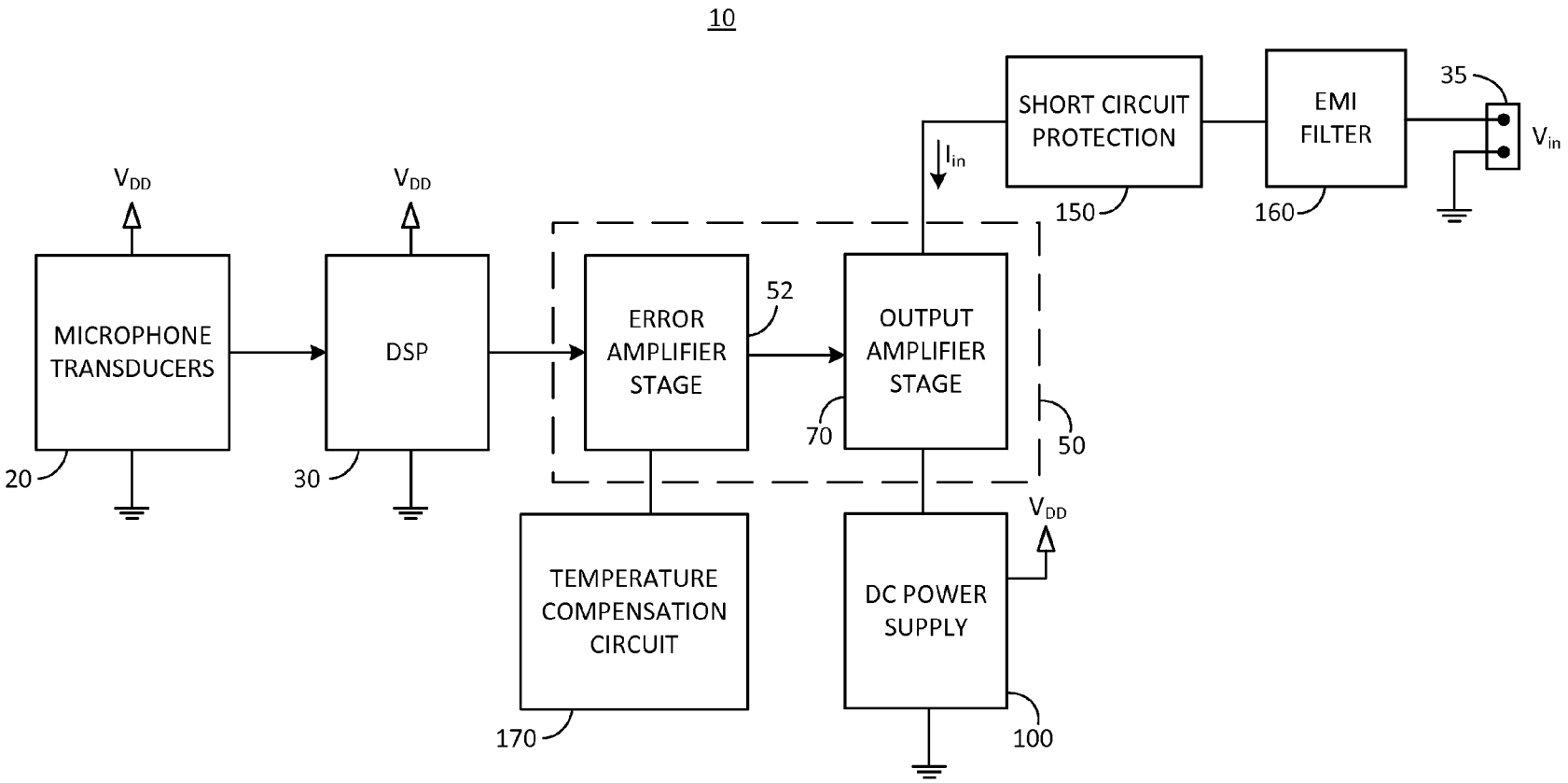
FIG. 2 is a more detailed electrical circuit diagram in block form of an implementation of the microphone circuit of FIG. 1.

FIG. 2 shows a more detailed example of low power microphone circuit 10. In this example, output amplifier 50 is shown as including two stages, namely—an error amplifier stage 52 and an output amplifier stage 70, wherein error amplifier stage 52 amplifies the audio signal from DSP 30 and supplies the amplified audio signal to output amplifier stage 70.

Low power microphone circuit 10 may further include a short circuit protection circuit 150 for protecting the low power microphone circuit from short circuits, and an electromagnetic interference (EMI) filter 160 for filtering out any EMI present on the power supply line at terminal 35. In addition, low power microphone circuit 10 may further include a thermal compensation circuit 170 for compensating for temperature-dependent voltage variations. Examples of these circuits are described in detail below with reference to FIG. 3.

Figure 3:
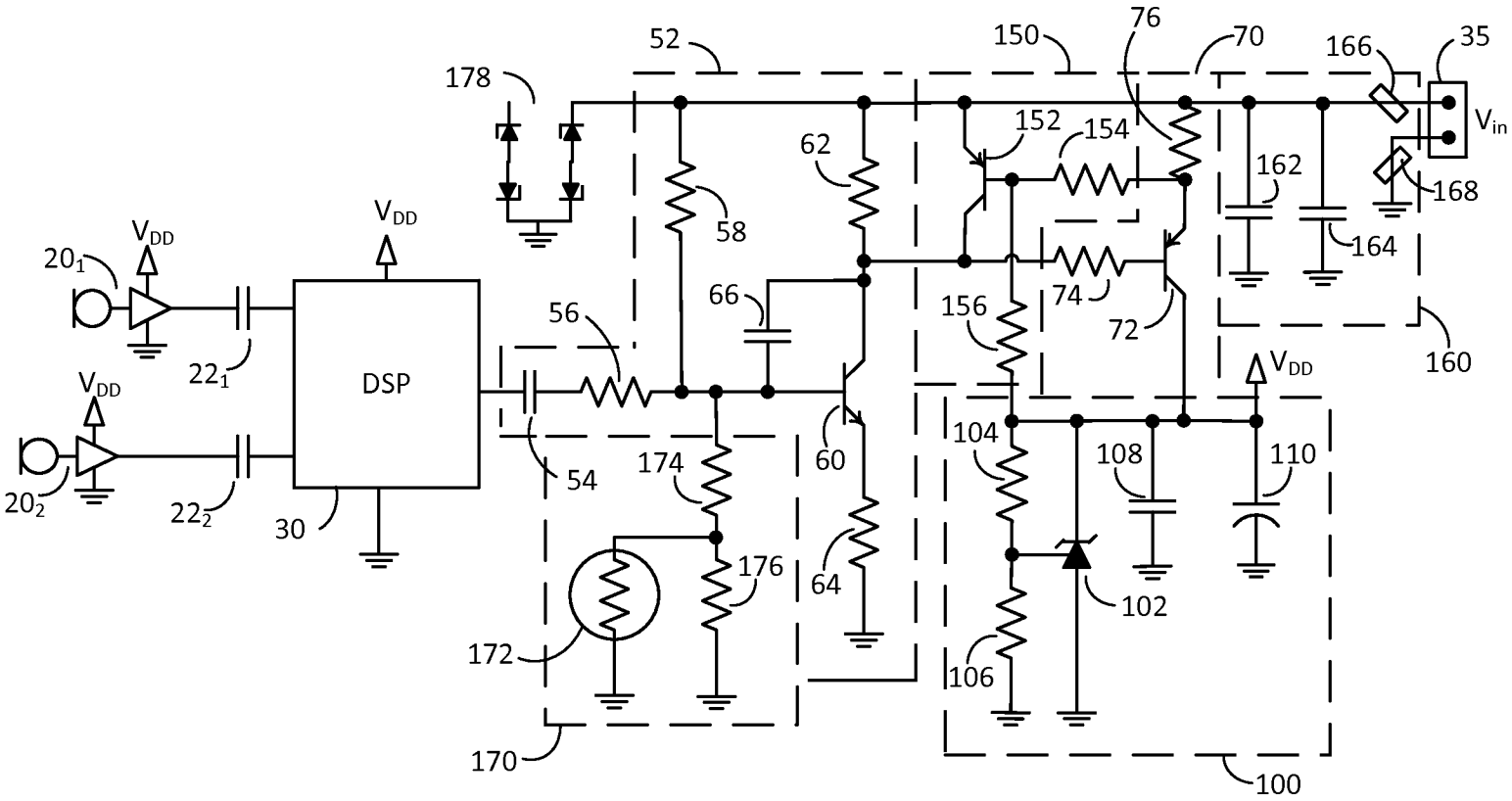
FIG. 3 is an electrical circuit diagram in block and schematic form illustrating an example of a detailed implementation of the microphone circuit of FIG. 1.

As shown in FIG. 3, two microphones $\mathbf{20}_1$ and $\mathbf{20}_2$ have their outputs connected to DSP 30 via respective capacitors $\mathbf{22}_1$ and $\mathbf{22}_2$, which may have capacitances of 0.022 μF, for example. Microphones $\mathbf{20}_1$ and $\mathbf{20}_2$ are powered by voltage $V_{DD}$ as is DSP 30. As in the embodiments disclosed above, $V_{DD}$ is provided by DC power supply 100, which is described below.

DSP 30 may have a digital-to-analog converter (DAC) at one of its output ports, which outputs a digitally processed audio signal based upon processing of the signals from the microphones. This audio signal is output to error amplifier stage 52 of output amplifier 50. DSP 30 may optionally monitor DC voltage level $V_{DD}$ in a software feedback and then perform an active trim on a DC bias if there is variation in DC voltage level $V_{DD}$. In this regard, general purpose I/O resistors in parallel could be used to produce the variable DC bias for a course trim or an output port of DSP 30 could be tri-stated to control the DC bias.

Error amplifier stage 52 includes a transistor 60 whose base is coupled to the DAC output of DSP 30 via serially connected first capacitor 54 and first resistor 56. The collector of transistor 60 is coupled to the $V_{in}$ input rail from terminal 35 via a second resistor 62. The emitter of transistor 60 is coupled to ground via a third resistor 64. A fourth resistor 58 is coupled between the base of transistor 60 and the upper rail from connector 35. A second capacitor 66 may be coupled between the base and collector of transistor 60 for additional protection against electromagnetic currents. In this error amplifier stage 52, the gain of the amplifier is equal to the resistance of fourth resistor 58 divided by the resistance of first resistor 56. For purposes of example only, first capacitor 54 may have a capacitance of 0.1 μF, first resistor 56 may have a resistance of 16.5 kΩ, second resistor 62 has a resistance of 10 kΩ, third resistor 64 has a resistance of 220Ω, fourth resistor 58 has a resistance of 51.1 kΩ, and second capacitor 66 has a capacitance of 330 pF.

Output amplifier stage 70 includes a transistor 72, a resistor 74, and a resistor 76. The collector of transistor 60 of error amplifier stage 52 is coupled to the base of transistor 72 via resistor 74. Resistor 74 may, for example, have a resistance of 470Ω, and resistor 76 may, for example, have a resistance of 12Ω. The collector of transistor 72 is coupled to the $V_{in}$ power rail from terminal 35 via resistor 76, while the emitter of transistor 72 is coupled to DC power supply 100 so as to provide the aforementioned serial connection between the output amplifier 50 and DC power supply 100.

DC power supply 100 is shown in this particular embodiment as being a shunt regulator. DC power supply 100 may thus include a low-voltage adjustable shunt regulator such as part No. TLV431 available from Texas Instruments of Dallas, Tex., which provides a thermally stable reference voltage of 1.5 V, for example, which serves as voltage $V_{DD}$. Shunt regulator 102 is preferably connected between the emitter of transistor 72 and ground. Coupled in parallel between the emitter of transistor 72 and ground is a pair of serially connected resistors 104 and 106, a first capacitor 108, and a second capacitor 110. These components may, for example, have values as follows: resistor 104 may have a resistance of 24.9 kΩ, resistor 106 may have a resistance of 100 kΩ, capacitor 108 may have a capacitance of 0.1 μF, and capacitor 110 may have a capacitance of 47 μF. Because the voltage of the shunt regulator 102 is adjustable, resistors 104 and 106 provide a voltage divider such that a terminal between the resistors is coupled to the input of shunt regulator 102 that adjusts its output voltage.

Microphone circuit 10 may further include short circuit protection circuitry 150, which in the example shown in FIG. 3, may include a transistor 152 whose collector is coupled to the power rail $V_{in}$ provided from terminal 35. The base of transistor 152 is coupled to the collector of transistor 72 of the output amplifier stage via a resistor 154. The emitter of transistor 152 is coupled to the collector of transistor 60 of error amplifier stage 52. Short circuit protection 150 further includes a resistor 156 that is coupled to the base of transistor 152 and to the emitter of transistor 72. Short circuit protection 150 operates by turning on transistor 152 to pull the base of transistor 72 high when the current through resistor 76 and transistor 72 is too high. This effectively turns off transistor 72 to disrupt the high current. In addition, short circuit protection circuit 150 will further turn off transistor 72 when the voltage across resistor 156, and hence across transistor 72, becomes too low. The short circuit protection 150 thus serves as a single slope load line protector. As an example of the values of the components used in short circuit protection 150, resistor 154 may have a resistance of 5.6 kΩ, and resistor 156 may have a resistance of 100 kΩ.

EMI filter 160 may include a first capacitor 162 and a second capacitor 164, both coupled in parallel between the power rail $V_{in}$ from terminal 35 and ground. In addition, ferrite beads 166 and 168 may be provided at both inputs to terminal 35. For purposes of example only, capacitor 162 may have a capacitance of 0.01 μF and capacitor 164 may have a capacitance of 270 pF.

A temperature compensation circuit 170 may be provided to compensate for variances of the voltage $V_{be}$ between the base and emitter of transistor 60. In the example shown, a thermistor 172 is provided with a resistive divider including resistors 174 and 176. In the resistive divider, resistor 174 is coupled between the base of transistor 60 and resistor 176 whereas resistor 176 is coupled between resistor 174 and ground. Thermistor 172 is coupled at one end between resistors 174 and 176 and at the other end to ground. Temperature compensation circuit 170 thus provides a bias source that is a function of temperature. In the example provided, thermistor 172 may have a resistance of 10 kΩ and have a negative temperature coefficient. Resistors 174 and 176 may have resistance of 4.99 kΩ.

The microphone circuit may further include an electrostatic discharge (ESD) protection diode 178 to protect the microphone circuit components from ESD. A suitable ESD protection diode is part No. PESD1CAN available from NXP B.V. of Eindhoven, the Netherlands.

As apparent from the circuits described above, a method is provided for providing power to a microphone circuit having a DSP, an output amplifier, and a DC power supply, when a power source from which power is to be provided has an input current of no greater than about 6 mA. The method comprises: electrically connecting the output amplifier and the DC power supply in series such that the input current passes through both the output amplifier and the DC power supply; and providing power from the DC power supply to the DSP. The power supplied from the DC power supply to the DSP may be at a voltage of about 1.5 V.

Figure 4:
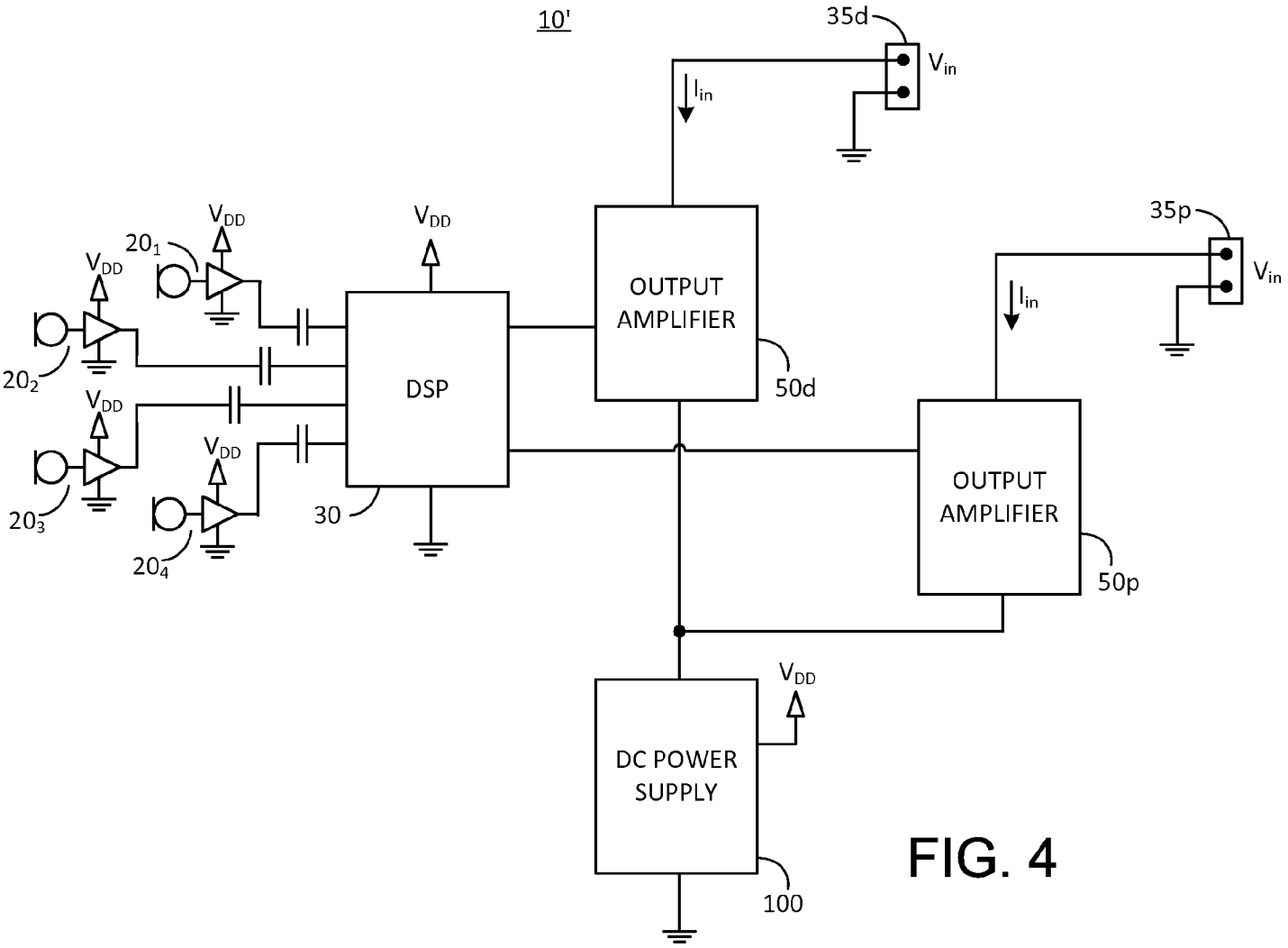
FIG. 4 is an electrical circuit diagram in block form of a microphone circuit according to another embodiment.

FIG. 4 shows an example of a microphone circuit 10' that is similar to that disclosed in FIG. 1 with the exception that DSP 30 receives inputs from two sets of microphones and outputs two audio signals. In general, when two sets of microphones are thus provided in a vehicle, there are two terminals 35*d* and 35*p*, which source first and second input currents, which may both be $I_{in}$ at respective first and second input voltages, which may both be $V_{in}$. In this example, a first pair of microphones $\mathbf{20}_1$ and $\mathbf{20}_2$ provides inputs to DSP 30. First and second microphones $\mathbf{20}_1$ and $\mathbf{20}_2$ are, for example, specifically positioned within the vehicle to pick up the voice of the driver. DSP 30 digitally processes these signals from microphones $\mathbf{20}_1$ and $\mathbf{20}_2$ to provide a driver side first audio signal, which is provided to a first output amplifier 50*d*. First output amplifier 50*d* amplifies the first audio signal by modulating the first input voltage. First output amplifier 50*d* may, for example, include the circuitry disclosed in FIGS. 2 and 3.

Third and fourth microphones $\mathbf{20}_3$ and $\mathbf{20}_4$ may be positioned to pick up speech signals from the passenger side of the vehicle, and thus DSP 30 may separately digitally process these signals to produce a passenger-side second audio signal that is output to a second output amplifier 50*p*. Second output amplifier 50*p* amplifies the second audio signal by modulating the second input voltage. Again, output amplifier 50*p* may be configured as disclosed above with respect to FIGS. 2 and 3. Because first and second terminals 35*d* and 35*p* source first and second input currents, which may both be $I_{in}$ at respective first and second input voltages, which may both be $V_{in}$, each of output amplifiers 50*d* and 50*p* may be sourced with the same amount of current and voltage as would be the case when a single output amplifier is provided as in the embodiment shown in FIG. 1.

In FIG. 4, the microphone circuit 10' is also shown as including a single DC power supply 100. DC power supply 100 may be configured with a shunt regulator as disclosed above with respect to FIG. 3 or as disclosed below. Although the voltage level applied at DC power supply 100 would be the same as in the embodiment disclosed above with respect to FIG. 1, one difference is that the input currents $I_{in}$ would be summed thereby doubling the current provided to DC power supply 100 and hence to DSP 30 and microphones $\mathbf{20}_1$ through $\mathbf{20}_4$.

The above microphone circuits may be used with the auto-bias microphone system for use with multiple loads as described in commonly-assigned U.S. Pat. No. 8,243,956, the entire disclosure of which is incorporated herein by reference.

In VDA microphone systems, a very significant source of power loss can be the voltage regulator input circuitry. The supply and voltage regulator typically utilize a power supply capacitance that is AC isolated from the VDA output signal which appears or is impressed across the microphone. However, the power supply provides a DC path to provide power to the microphone while providing AC isolation. Although an inductor can provide this function, it typically would be a very large physical size and be very costly due to the large inductance required to accomplish this function. Although a resistor is small and an inexpensive solution, a resistor will incur significant power loss since it will appear as an AC load in parallel with the 680Ω VDA load.

Figure 5:
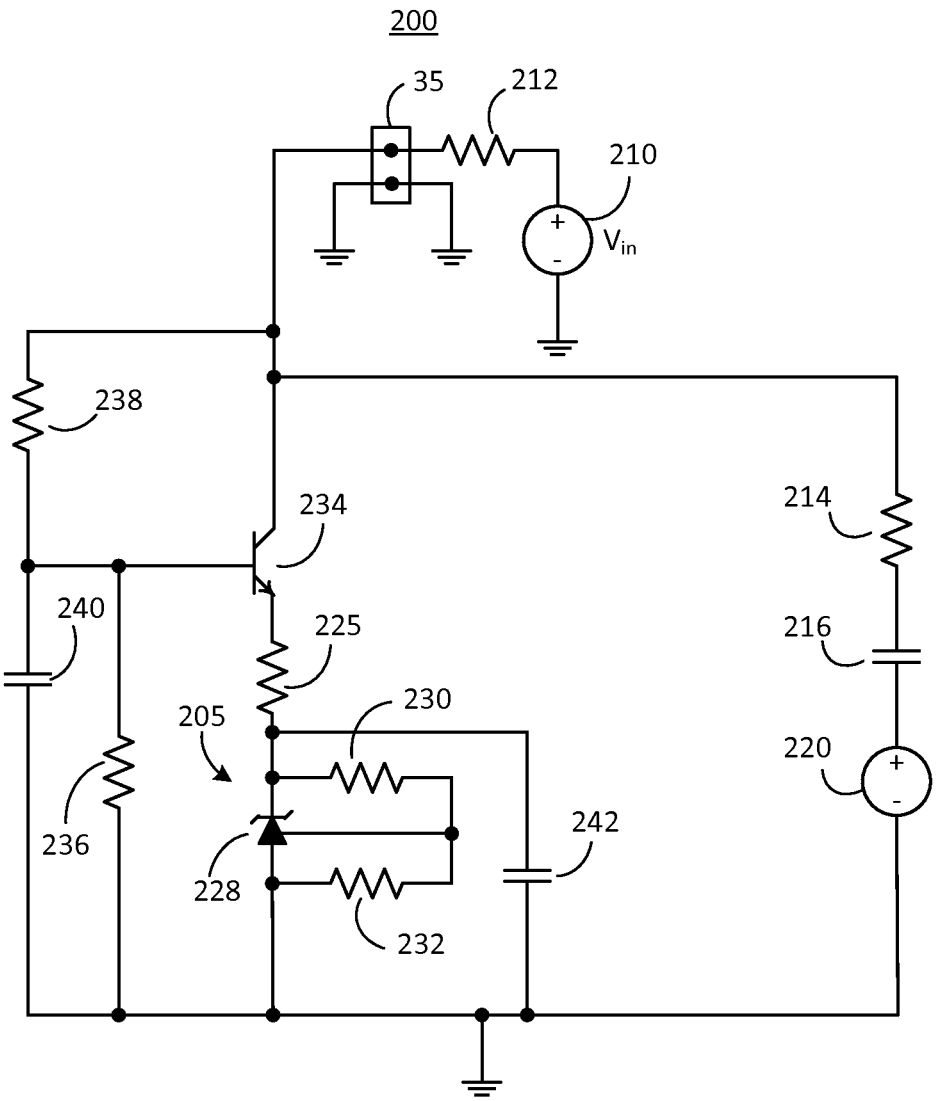
FIG. 5 is a schematic diagram of an implementation of a microphone circuit according to another embodiment.

FIG. 5 shows a SPICE model of another embodiment of a low power microphone circuit 200 wherein a simulated inductance 205 is used in place of the shunt regulator of FIG. 3. In this embodiment, a power supply for a low power audio output stage is used having a single ended active load. Power is supplied at a terminal 35 by a vehicle voltage source 210 through resistor 212. Resistor 214 and capacitor 216 then are used to supply an AC voltage to a load 220, represented as a voltage source. Voltage source load 220 may represent an amplifier, which may be a Class-B, Class-D or other amplifier type. In order to enable additional loading on the supply at resistor 212, this embodiment further includes a simulated inductance 205 or active load comprised of a biasing resistor 225, and programmable shunt regulator 228 (TLV431 or similar) in combination with voltage programming resistors 230 and 232. The DC current is supplied through the collector-emitter junction of transistor 234 for providing a power supply input impedance that varies with frequency. Transistor 234 is biased by resistors 236 and 238 and capacitor 240. A capacitor 242 may be coupled across simulated inductance 305. Thus, the input impedance looking into the collector of the active load will provide a low impedance for DC signals and a high impedance for AC signals, thus improving overall efficiency.

Figure 6:
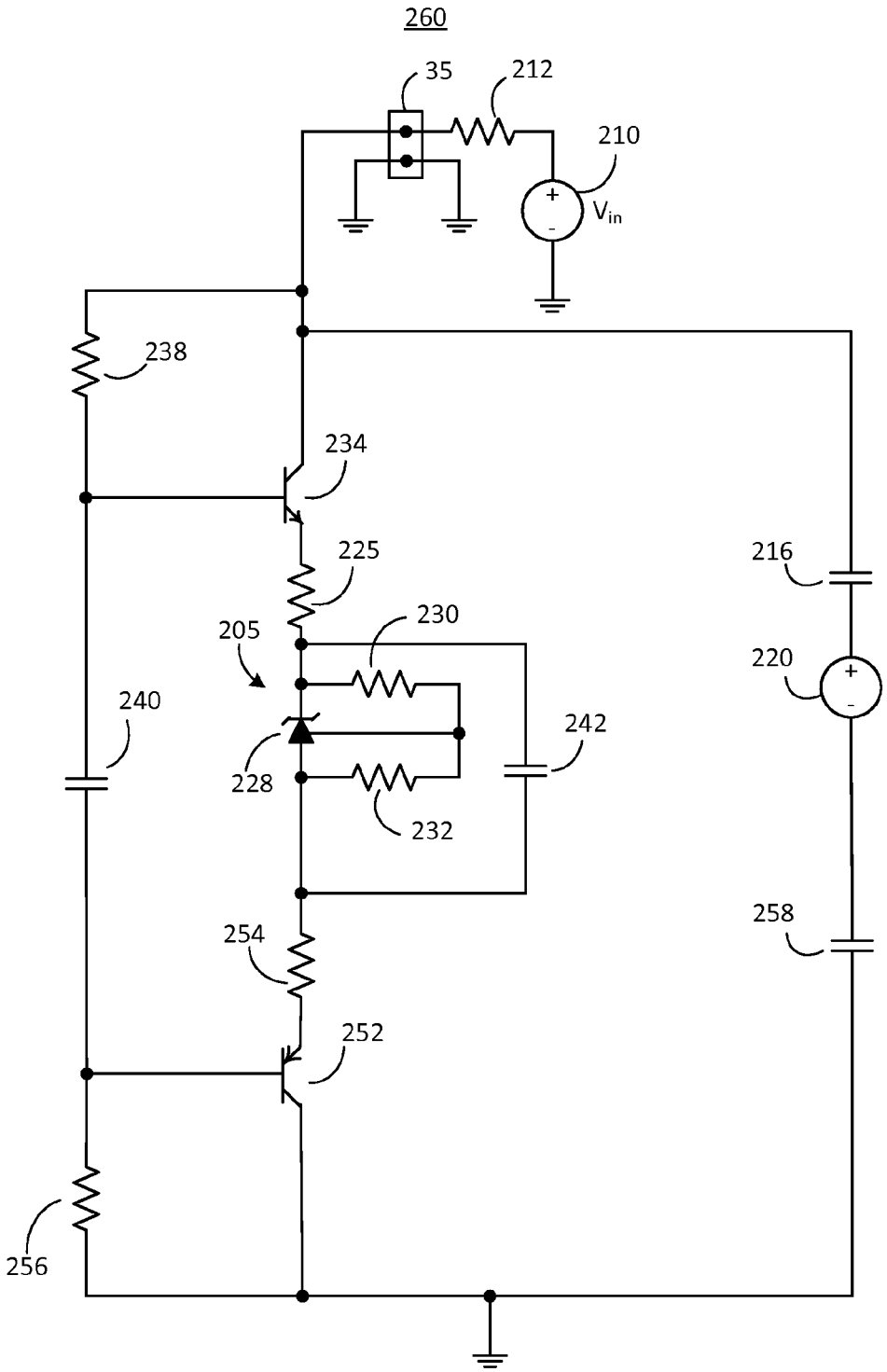
FIG. 6 is a schematic diagram of an implementation of a microphone circuit according to another embodiment.

FIG. 6 illustrates a schematic diagram of a SPICE model showing a low power amplifier output stage 250 having a balanced output. Load 220 would typically be implemented by using two identical output stages with output signals 180 degrees out of phase. The circuit shown in FIG. 6 is similar to that shown in FIG. 5, consisting of a programmable shunt regulator 228 and resistors 230 and 232 serving as a simulated impedance 205. The shunt regulator is positioned between two active loads implemented by solid state transistor 234, transistor 252, resistor 225, and resistor 254 where these devices are biased from resistor 212 through resistors 238 and 256 and capacitor 240. As with FIG. 5, this balanced output embodiment powers microphone circuitry in parallel with shunt regulator 205. The amplifier load 220 output signal is coupled through capacitor 216 and capacitor 258. Capacitor 242 is coupled across the simulated impedance 205.

Thus, the circuits as described in FIG. 5 and FIG. 6 provide an AC load impedance at an order of magnitude or two higher than resistive isolation. A constant current source can be used for power supply isolation but can saturate when the voltage across the microphone is low causing excessive distortion. In use, the VDA microphone power supply may draw a constant current. Otherwise, variations in computation load or output signal amplitude will add a distortion component to the desired output signal. As seen in FIG. 5, the shunt regulator 228 insures that the load current on the VDA interface remains constant so that the desired output signal is not distorted. The load may be placed in parallel with the shunt regulator 228. Alternatively, shunt regulation could also be implemented using a Zener diode, a series diode string, $V_{be}$ multiplier or equivalent.

The AC current regulator can be combined with a Class-B, Class-D or other type output stage. Additionally, the output stage can be implemented with complementary (balanced) outputs. A balanced output stage can double the output swing for a given shunt regulator voltage and has EMI and distortion advantages for Class-B and Class-D output stages due to even harmonic cancellation. Alternatively, a Class-A output stage in series with a shunt regulator can also be used. In this case the low impedance power supply does not need to be isolated as it is in series with the Class-A output stage. The bias current of the Class-A stage is delivered to the shunt regulator and its parallel load and is therefore not wasted. Capacitance in parallel with the shunt regulator is added to supply uninterrupted load current during signal peaks.

Figure 7:
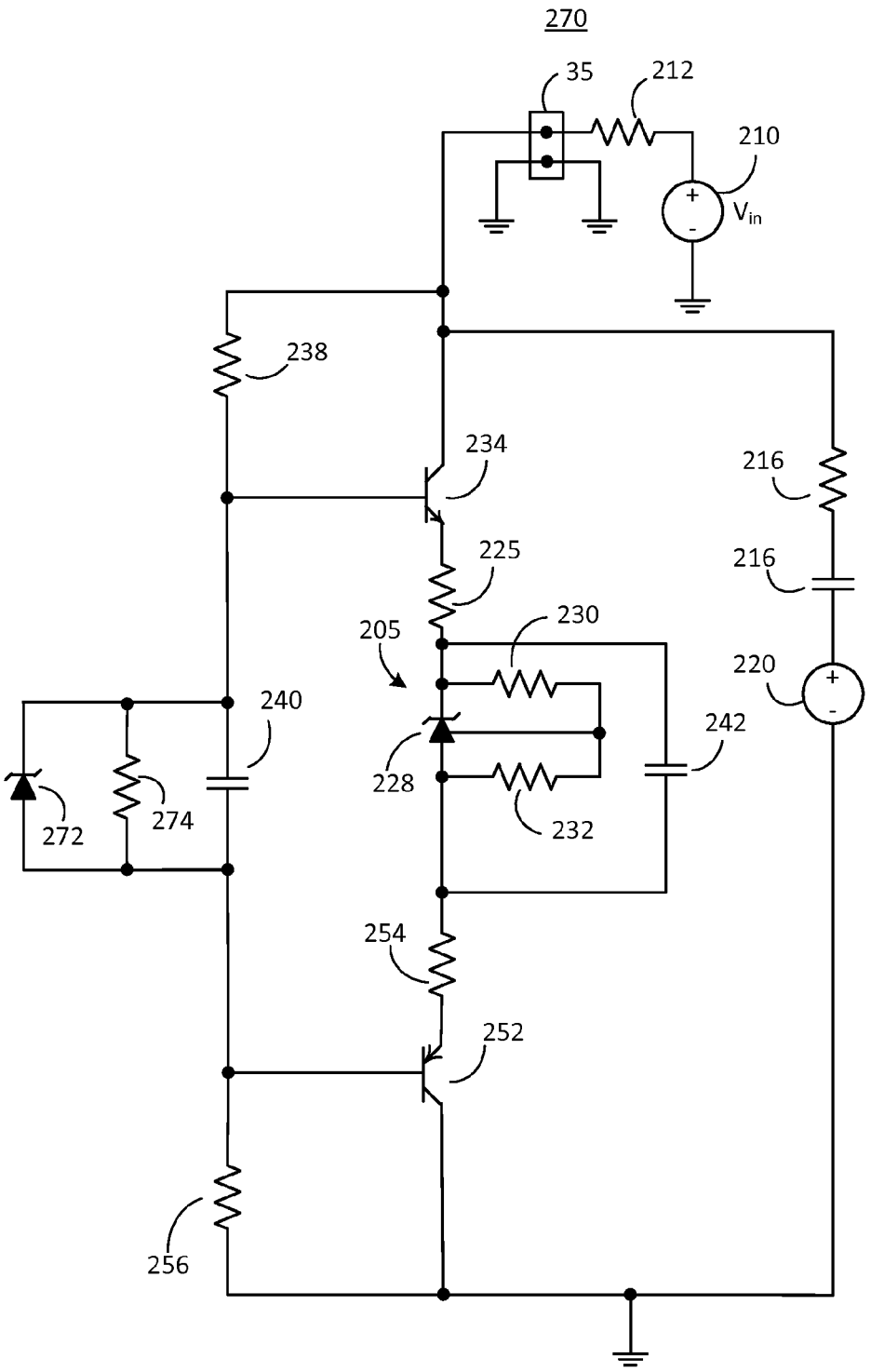
FIG. 7 is a schematic diagram of an implementation of a microphone circuit according to another embodiment.

FIG. 7 illustrates a SPICE diagram of a low power microphone circuit 270 with a balanced output stage similar to that shown in FIG. 6, but with protection from short circuits. This could occur if resistor 212 were shorted or if an accidental connection were made from the vehicle 12V bus to the junction of resistors 212, 238, and 214 and the collector of transistor 234. Short circuit protection is provided by a diode 272 and a resistor 274. Diode 372 is normally non-conducting, but limits the voltage difference between the bases of transistor 234 and transistor 252 during a short circuit. This causes transistor 234 and transistor 252 to behave as current sources for the duration of the short, preventing damage to the microphone. For better DC balance, resistor 374 may be eliminated and replaced by two approximately equal-valued resistors where one resistor is connected from the base of transistor 234 to the collector of transistor 252 and the other resistor is connected from the base of transistor 252 to the collector of transistor 234. For purposes of example only, resistor 212 may have a resistance of 680Ω, resistor 214 may have a resistance of 75Ω, resistor 225 may have a resistance of 47Ω, resistor 230 may have a resistance of 13.9 kΩ, resistor 232 may have a resistance of 49.9 kΩ, resistor 238 may have a resistance of 4.7 kΩ, resistor 254 may have a resistance of 47Ω, resistor 256 may have a resistance of 4.7 kΩ, resistor 274 may have a resistance of 47 kΩ, capacitor 216 may have a capacitance of 10 μF, capacitor 240 may have a capacitance of 0.47 μF, and capacitor 242 may have a capacitance of 33 μF.

As noted above, in situations where a class-B amplifier output stage is used, a maximum efficiency of only about 30% for sine wave signals is possible which typically requires high amounts of supply current. However, other types of amplifiers like Class-D amplifiers can have substantially higher efficiencies of typically 80-90%. This can help to reduce the power overall requirement. Thus, by increasing the output stage efficiency, this can allow more power availability that can be used for a greater signal voltage swing or more power being available for digital signal processing and/or both.

Figure 8:
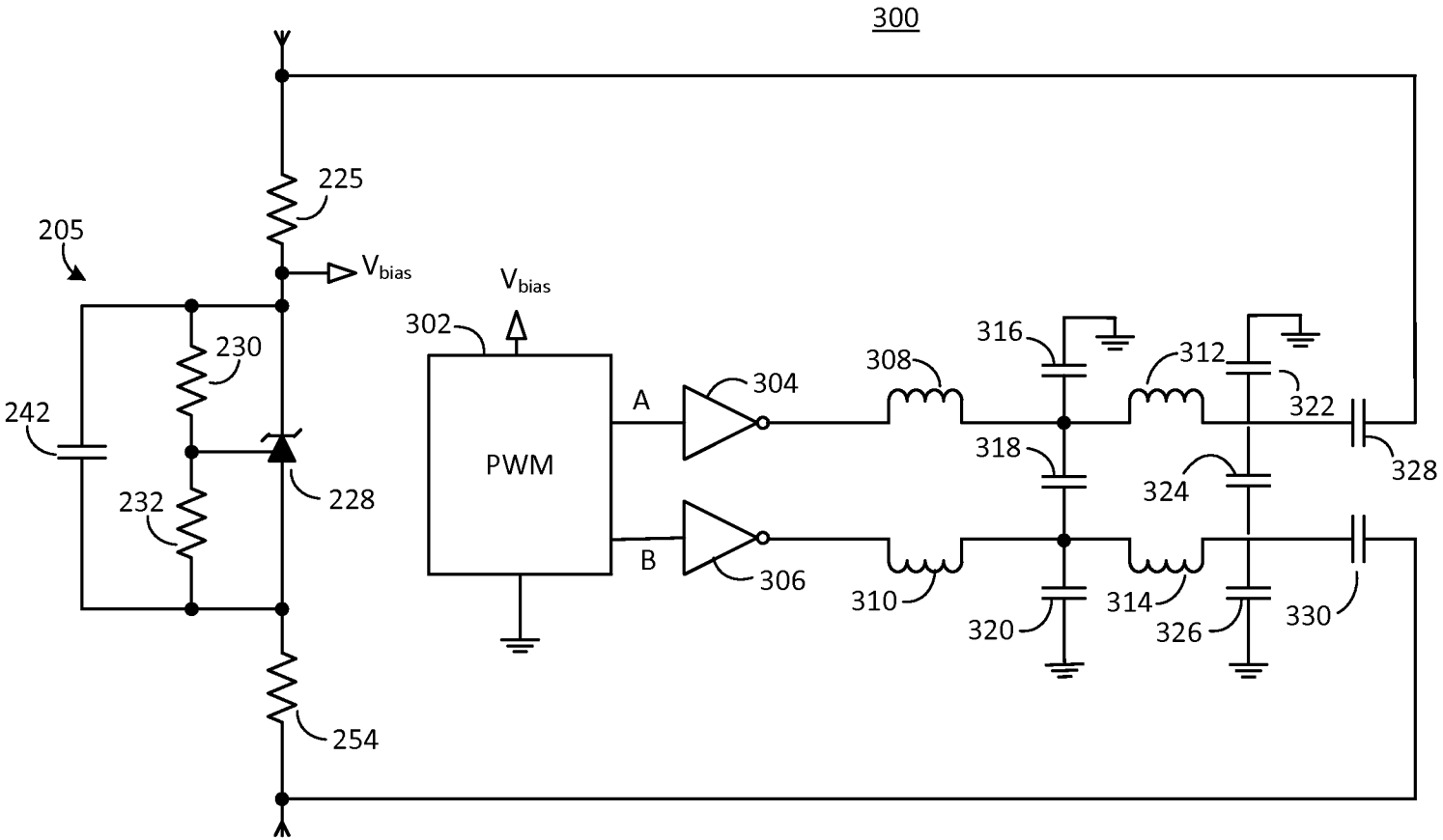
FIG. 8 is a schematic diagram of a balanced Class-D microphone output stage.

FIG. 8 is a schematic of a balanced Class-D microphone output stage 300. Block 302 marked PWM generates logic level pulse-width-modulated signals that when low pass filtered, yield the desired analog output voltages. Typically, signal B is the inversion of signal A. It is also possible to generate PWM signals where A and B are sometimes equal to add a third modulation state. PWM 302, which may be from a DSP, receives power $V_{bias}$ from a DC power supply in the form of a simulated inductance 205 similar to that shown in FIG. 7. Buffers 304 and 306 are optional buffers or level translators used to increase the voltage swing and/or current capacity beyond what is available from the PWM block 302. Inductors 308-314 and capacitors 316-326 form a balanced low-pass filter. A fourth order filter is shown, but any order filter may be used depending on EMI (electromagnetic interference) requirements. The inductors may be replaced by resistors or RL networks, although this will reduce efficiency. The capacitors may also be replaced by RC networks. The output of the low-pass filter is the desired analog output signal. Capacitors 324 and 326 block the DC component of the Class-D outputs and couple the audio output signal onto the microphone interface lines.

Figure 9:
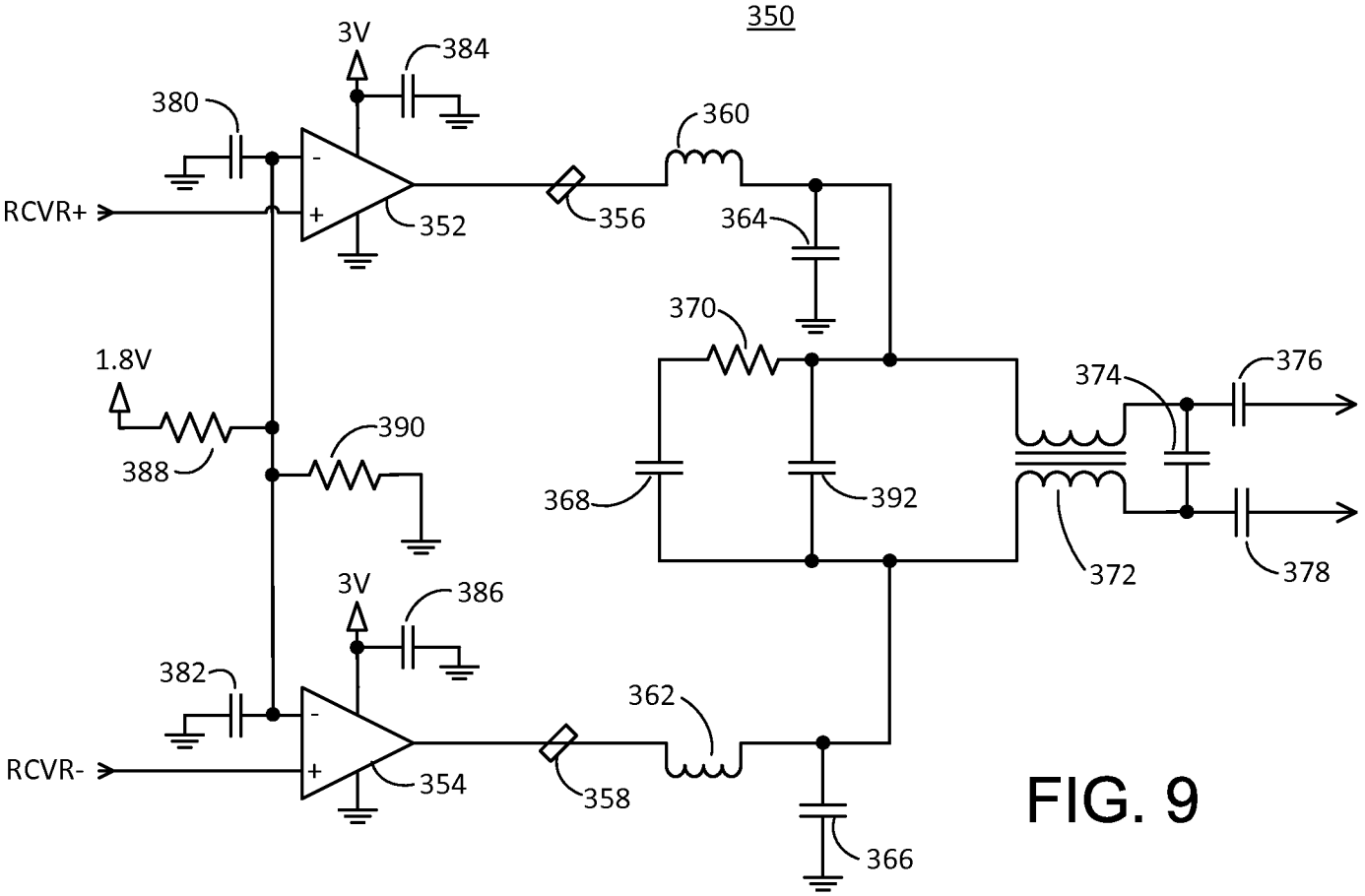
FIG. 9 is a schematic diagram of a Class-D output stage with EMI suppression components.

FIG. 9 is a schematic of a Class-D output stage 350 with EMI suppression components. Buffers 352 and 354 perform the buffer function. Capacitors 384 and 386 are coupled to respective power inputs of buffers 352 and 354. Ferrite beads 356 and 358 are substantially equivalent to an RL network consisting of an inductor in parallel with a resistor. Inductors 360 and 362 and capacitors 364 and 366 form a balanced fourth order low-pass filter. Resistor 370 and capacitor 368 form a RC network, which terminates the filter at high frequencies. The frequency of the RC network may be above or below the audio band. Inductor 372 is a common-mode choke used to reduce EMI. Capacitors 374 and 392 are also primarily used for EMI reduction. Capacitors 380 and 382 block the DC component of the Class-D outputs and couple the audio output signal (RCVR+ and RCVR−) onto the microphone interface lines. Capacitors 380 and 382 are coupled together and to a resistor 388, which is coupled to a voltage input and to resistor 390, which is coupled to ground. The circuit may be simplified to an unbalanced version by eliminating buffer 354, ferrite bead 358, inductor 362 and replacing capacitor 366 with a connection to ground. The EMI and distortion performance will tend to be worse, however, and the 3V power supply ripple will tend to increase. Capacitors 376 and 378 are coupled to respective outputs of the Class-D outputs.

For purposes of example only with respect to FIG. 9, resistor 388 may have a resistance of 10 kΩ, resistor 290 may have a resistance of 10 kΩ, resistor 370 may have a resistance of 47Ω, capacitor 380 may have a capacitance of 0.01 μF, capacitor 382 may have a capacitance of 0.01 μF, capacitor 384 may have a capacitance of 1 μF, capacitor 386 may have a capacitance of 1 μF, capacitor 364 may have a capacitance of 0.022 μF, capacitor 366 may have a capacitance of 0.022 μF, capacitor 368 may have a capacitance of 0.047 μF, capacitor 392 may have a capacitance of 0.01 μF, capacitor 374 may have a capacitance of 0.01 μF, capacitor 376 may have a capacitance of 10 μF, capacitor 378 may have a capacitance of 10 μF, inductors 360 and 362 may have inductances of 1 mH, and buffers may be implemented using part No. MCP6561 available from Microchip Technology Inc. of Chandler, Ariz.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the claims as interpreted according to the principles of patent law, including the doctrine of equivalents.

What is claimed is:

1. A low power microphone circuit for a vehicle, comprising:

at least one microphone transducer;

a digital signal processor for receiving output signals from said at least one microphone transducer and for generating a digitally processed audio signal;

an output amplifier for amplifying the audio signal from said digital signal processor and modulating an input voltage with the audio signal; and a DC power supply separate from the output amplifier for supplying power to said digital signal processor;

said at least one microphone includes a first microphone transducer and a second microphone transducer;

said digital signal processor processes output signals from said first and second microphone transducers to produce a first audio signal, wherein said output amplifier amplifies the first audio signal by modulating a first input voltage;

the low power microphone circuit further comprising:

a first terminal for connection to a vehicle power source providing the first input voltage and a first input current, said first terminal coupled to said output amplifier;

a second terminal for connection to the vehicle power source providing a second input voltage and a second input current; and a second output amplifier coupled to said second terminal, wherein said output amplifier and said DC power supply are electrically coupled in series.

2. The low power microphone circuit of claim 1 and further including a terminal for connection to a vehicle power source providing the input voltage and an input current, wherein said output amplifier is coupled between said terminal and said DC power supply and wherein said DC power supply is coupled between said output amplifier and ground.

3. The low power microphone circuit of claim 2, wherein the input current is no greater than about 6 mA.

4. The low power microphone circuit of claim 1, wherein said DC power supply is a shunt regulator.

5. The low power microphone circuit of claim 1, wherein said DC power supply is a simulated inductor circuit.

6. The low power microphone circuit of claim 1, wherein said DC power supply provides a DC voltage of about 1.5 V to said digital signal processor.

7. The low power microphone circuit of claim 1 and further comprising a short circuit protection circuit for protecting the low power microphone circuit from short circuits.

8. The low power microphone circuit of claim 1 and further comprising a thermal compensation circuit for compensating for temperature-dependent voltage variations.

9. The low power microphone circuit of claim 1, wherein said output amplifier includes an error amplifier stage and an output amplifier stage, wherein said error amplifier stage amplifies the audio signal from said digital signal processor and supplies the amplified audio signal to said output amplifier stage.

10. The low power microphone circuit of claim 8, wherein said error amplifier stage includes a transistor having a base, an emitter, and a collector, wherein said thermal compensation circuit compensates for temperature-dependent variations in base-to-emitter voltage ($V_{be}$) of said transistor.

11. The low power microphone circuit of claim 1, wherein:

said at least one microphone includes a third microphone transducer and a fourth microphone transducer; said digital signal processor processes output signals from said third and fourth microphone transducers to produce a second audio signal said second output amplifier amplifies the second audio signal from said digital signal processor and modulates the second input voltage with the second audio signal.

12. The low power microphone circuit of claim 11, wherein said second output amplifier is also coupled in series with said DC power supply such that said DC power supply receives the sum of the first input current and the second input current.

13. A low power microphone circuit for a vehicle, comprising:

at least one microphone transducer;

a digital signal processor for receiving output signals from said at least one microphone transducer and for generating a digitally processed audio signal;

a terminal for connection to a vehicle power source providing an input voltage and an input current;

an output amplifier for amplifying the audio signal from said digital signal processor and modulating the input voltage with the audio signal; and a DC power supply separate from the output amplifier for supplying power to said digital signal processor;

said at least one microphone includes a first microphone transducer and a second microphone transducer;

said digital signal processor processes output signals from said first and second microphone transducers to produce a first audio signal, wherein said output amplifier amplifies the first audio signal by modulating the input voltage;

the low power microphone circuit further comprising:

a second terminal for connection to the vehicle power source providing a second input voltage and a second input current; and a second output amplifier coupled to said second terminal, wherein said DC power supply and said output amplifier are powered by the input current, and wherein the input current is no greater than about 6 mA.

14. The low power microphone circuit of claim 13, wherein the input current is no greater than about 4.7 mA.

15. The low power microphone circuit of claim 13, wherein said output amplifier is a class D amplifier.

16. The low power microphone circuit of claim 13, wherein said DC power supply is a shunt regulator.

17. The low power microphone circuit of claim 13, wherein said DC power supply is a simulated inductor circuit.

18. The low power microphone circuit of claim 13, wherein said DC power supply provides a DC voltage of about 1.5 V to said digital signal processor.

19. A method of providing power to a microphone circuit having a digital signal processor, an output amplifier, and a DC power supply, when a power source from which power is to be provided has an input current of no greater than about 6 mA, the method comprising:

electrically connecting the output amplifier, which is separate from the DC power supply, and the DC power supply in series such that the input current passes through both the output amplifier and the DC power supply; the microphone circuit further includes a first microphone transducer and a second microphone transducer;

a second terminal for connection to the vehicle power source providing a second input voltage and a second input current, and a second output amplifier coupled to the second terminal, wherein the first terminal is coupled to the output amplifier, the method further comprising:

using the digital signal processor to process output signals from the first and second microphone transducers to produce a first audio signal;

using the output amplifier to amplify the first audio signal by modulating a first input voltage;

using the second output amplifier to amplify the second audio signal from the digital signal processor and modulates the second input voltage with the second audio signal;

wherein the microphone circuit further includes a first microphone transducer and a second microphone transducer;

a first terminal for connection to a vehicle power source providing a first input voltage and a first input current;

a second terminal for connection to the vehicle power source providing a second input voltage and a second input current; and a second output amplifier coupled to the second terminal, wherein the first terminal is coupled to the output amplifier;

using the digital signal processor to process output signals from the first and second microphone transducers to produce a first audio signal;

using the output amplifier to amplify the first audio signal by modulating a first input voltage; and providing power from the DC power supply to the digital signal processor.

20. The method of claim 19, wherein the power supplied from the DC power supply is at a voltage of about 1.5 V.

21. The method of claim 19, wherein the microphone circuit further includes a third microphone transducer and a fourth microphone transducer; using the digital signal processor to process output signals from the third and fourth microphone transducers to produce a second audio signal; and using the second output amplifier to amplify the second audio signal from the digital signal processor and modulates the second input voltage with the second audio signal.

22. The low power microphone circuit of claim 13, wherein: said at least one microphone includes a third microphone transducer and a fourth microphone transducer; said digital signal processor processes output signals from said third and fourth microphone transducers to produce a second audio signal; said second output amplifier amplifies the second audio signal from said digital signal processor and modulates the second input voltage with the second audio signal.

* * * * *